US006792226B2

(12) United States Patent
Chikano

(10) Patent No.: US 6,792,226 B2
(45) Date of Patent: Sep. 14, 2004

(54) IMAGE FORMING APPARATUS INCLUDING A COOLING DEVICE

(75) Inventor: Hisao Chikano, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/670,282

(22) Filed: Sep. 26, 2003

(65) Prior Publication Data

US 2004/0062564 A1 Apr. 1, 2004

Related U.S. Application Data

(63) Continuation of application No. 10/356,629, filed on Feb. 3, 2003, now Pat. No. 6,701,104.

(30) Foreign Application Priority Data

Feb. 4, 2002 (JP) ..... 2002-026662

(51) Int. Cl.[7] ..... G03G 21/00
(52) U.S. Cl. ..... 399/92; 399/107
(58) Field of Search ..... 399/91, 92, 93, 399/94, 96, 97, 98, 107

(56) References Cited

U.S. PATENT DOCUMENTS 4,801,981 A 1/1989 Chikano et al.
5,087,932 A 2/1992 Chikano
5,255,060 A 10/1993 Chikano
6,070,026 A * 5/2000 Claflin et al. ..... 399/92
6,219,504 B1 * 4/2001 Matsuzaki et al. ..... 399/92
6,505,018 B2 * 1/2003 Fukutome ..... 399/92

FOREIGN PATENT DOCUMENTS

| | | |
|---|---|---|
| JP | 2000-047551 | 2/2000 |
| JP | 2001-005354 | 1/2001 |
| JP | 2001-013856 | 1/2001 |
| JP | 2001-318576 | 11/2001 |

* cited by examiner

*Primary Examiner*—Hoang Ngo
(74) *Attorney, Agent, or Firm*—Oblon, Spivak, McClelland, Maier & Neustadt, P.C.

(57) ABSTRACT

In an image forming apparatus including a cooling device that efficiently cools an inside of a main body of the image forming apparatus, the cooling device has an airflow path in which air taken in the main body of the image forming apparatus flows through a drum-shaped image carrier from a first end side of the image carrier, flows through the image carrier, and is discharged from a second end side of the image carrier, then makes a U-turn on the second end side of the image carrier, and flows through space between a toner storing device and a fixing device, and returns to a position on the first end side of the image carrier in the main body of the image forming apparatus. A fan may be provided at a position where the air makes a U-turn in the airflow path.

18 Claims, 5 Drawing Sheets

IMAGE FORMING APPARATUS INCLUDING A COOLING DEVICE

This application is a continuation of Ser. No. 10/356,629 filed Feb. 3, 2003, now U.S. Pat. No. 6,701,104.

BACKGROUND OF THE INVENTION

1. Field of the Invention

The present invention relates to an electrophotographic image forming apparatus such as a copying machine, a printer, a facsimile machine, etc. or a multi-functional image forming apparatus, and more particularly relates to a cooling device that leads air into the main body of an image forming apparatus to prevent an excessive rise in the temperature in the main body of the image forming apparatus.

2. Discussion of the Background

Due to the recent increasing demand for downsizing and speeding up an image forming apparatus, such as a copying machine, a facsimile machine, a printer, or other similar image forming apparatus, the temperature in the main body of an image forming apparatus tends to rise. In addition, because of the high speed of the image forming apparatus, the melting point of the toner is set at a lower temperature to enable a toner image to be more quickly fixed onto a transfer material. Therefore, it is now more important to prevent excessive temperatures in the main body of an image forming apparatus in order to avoid changing the properties of the toner—e.g., agglomerating or solidifying the toner particles.

A conventional image forming apparatus is constructed so that air is taken in a main body of the image forming apparatus from an air intake vent provided on one side surface of the main body of the image forming apparatus, and is discharged from an air exhaust vent provided on an opposite side surface of the main body of the image forming apparatus. When an image forming apparatus of this type is placed at a position adjacent to a wall in a room, so that the air intake vent is directed toward the wall, the air exhaust vent is directed to the user side, resulting in the increase in the noise level sensed by the user. In addition, when a fan is provided at the air exhaust vent, there may be an increase in the noise level coming from the main body of the image forming apparatus, thereby additionally annoying the user.

Therefore, it is desirable to provide an image forming apparatus which includes a cooling device that can efficiently cool the inside of the main body of the image forming apparatus, while suppressing the noise level sensed by users.

SUMMARY OF THE INVENTION

Accordingly, it is an object of the present invention to provide an image forming apparatus comprising a drum-shaped image carrier configured to carry a latent image. The image carrier comprises a first end side and a second end side on opposite ends of the longitudinal axis of the image carrier. The image forming apparatus further comprises a toner storing device disposed adjacent to the image carrier to store toner used for developing the latent image on the image carrier, thereby forming a toner image, and a fixing device configured to fix the toner image on a transfer material by heating. The fixing device is disposed parallel to the longitudinal axis of the image carrier. The image forming apparatus further comprises a cooling device configured to cool the inside of the main body of the image forming apparatus. The cooling device comprises an airflow path in which air enters a side of the main body of the image forming apparatus, enters the image carrier through the first end side of the image carrier, flows through the image carrier, and is discharged from the second end side of the image carrier. The airflow path then makes a U-turn on the second end side of the image carrier, and flows through a space between the toner storing device and the fixing device, and returns to a position on the first end side of the image carrier in the main body of the image forming apparatus.

BRIEF DESCRIPTION OF THE DRAWINGS

A more complete appreciation of the present invention and many of the attendant advantages thereof will be readily obtained by reference to the following detailed description, when considered in connection with the accompanying drawings.

DESCRIPTION OF THE PREFERRED EMBODIMENTS

Figure 1:
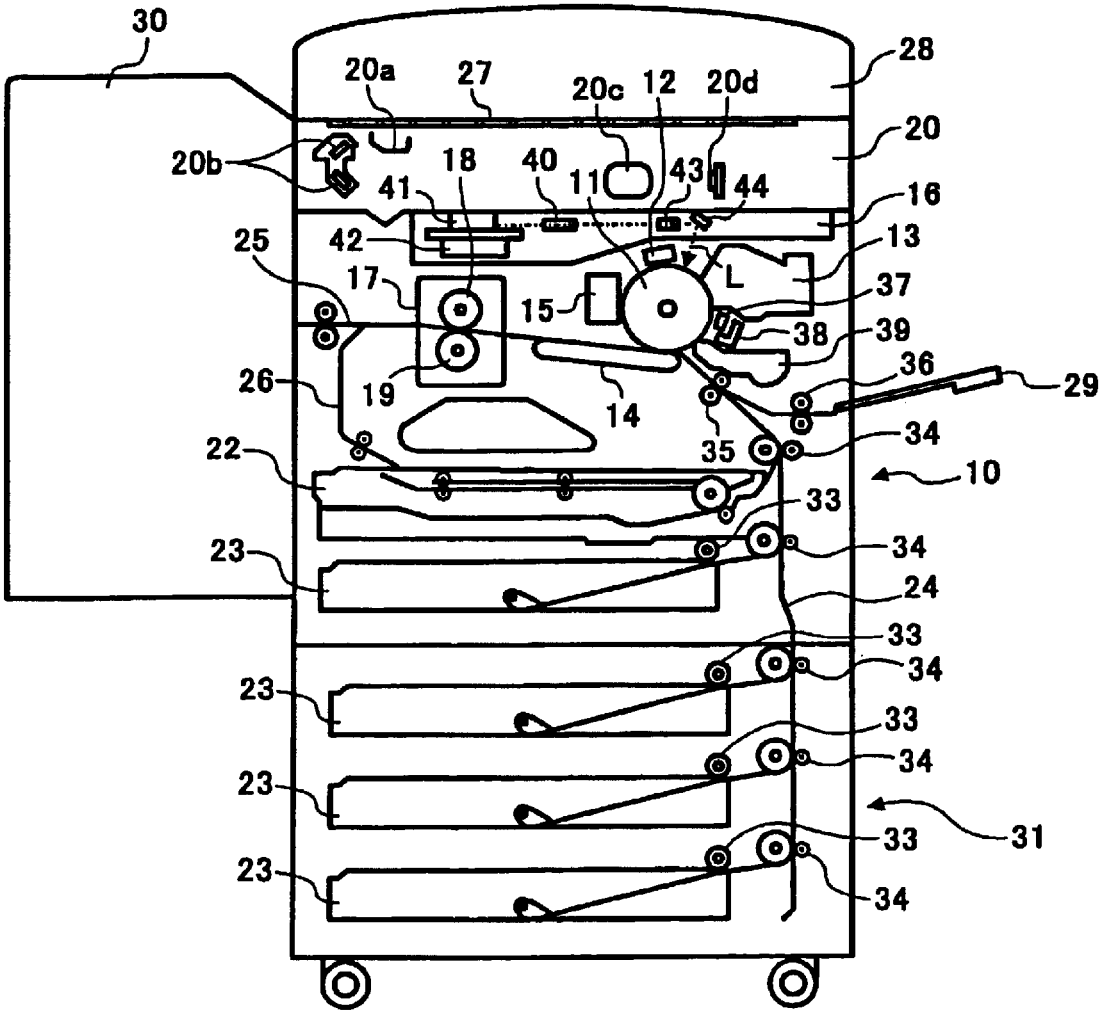
FIG. 1 is a schematic view of a two-color copying machine, as an example of an image forming apparatus according to one embodiment of the present invention.

Preferred embodiments of the present invention are described in detail with reference to the drawings, wherein like reference numerals designate identical or corresponding parts throughout the several views.

The image forming device of the present invention may be any type of image forming device, for example, a copying machine, printer, facsimile machine, etc. or a multi-functional image forming apparatus, in which images comprising one or more colors are formed on a transfer material.

FIG. 1 is a schematic view of a two-color copying machine as an example of an image forming apparatus according to one embodiment of the present invention. Referring to FIG. 1, the main body 10 of the copying machine includes a drum-shaped photoreceptor 11 used as an image carrier. Arranged around the photoreceptor 11 are a first charging device 12, a first developing device 13 containing black toner, a second charging device 37, a second laser writing device 38, a second developing device 39 containing red toner, a transfer/conveyance device 14, a cleaning device 15, etc.

The main body 10 of the copying machine further includes a first laser writing device 16 above the photoreceptor 11. The first laser writing device 16 includes an image scanning optical system including a light source 40, such as a laser diode, a rotary polygonal mirror 41, a motor 42, an f-theta lens 43, and a reflecting mirror 44. The f-theta lens 43 and the reflecting mirror 44 are made of plastic.

The main body 10 of the copying machine further includes a fixing device 17 provided in parallel with the photoreceptor 11 and at a left side of the cleaning device 15 in FIG. 1. The fixing device 17 includes a fixing roller 18 having an internal heater, and a pressure roller 19 which is pressed against the fixing roller 18.

The upper part of the main body 10 further includes an original document reading device 20. The original document reading device 20 includes a light source 20*a*, a plurality of mirrors 20*b*, an imaging lens 20*c*, and an image sensor 20*d*, such as a charge-coupled device (CCD).

At a lower part of the main body 10, a duplex unit 22 and a sheet feeding cassette 23 are vertically stacked. Each of the sheet feeding paths extending from the duplex unit 22 and the sheet feeding cassette 23 leads to a sheet conveying path 24 that extends toward a lower part of the photoreceptor 11. A reverse path 26 branching off from a sheet discharging path 25 extending from an outlet of the fixing device 17 is connected to the duplex unit 22.

A contact glass 27 is provided at a top surface of the main body 10 of the copying machine. An auto document feeder 28 is attached onto the main body 10 such that the auto document feeder 28 covers and uncovers the contact glass 27.

At a right side surface of the main body 10 in FIG. 1, a rotatable manual sheet feeding tray 29 is provided to feed a transfer material, such as a transfer sheet or a transparency, to the sheet conveying path 24. At a left side surface of the main body 10 in FIG. 1, a sorter 30 is provided to receive the transfer material discharged from the main body 10 through the sheet discharging path 25. The copying machine further includes a sheet feeding table 31 below the main body 10. There are a plurality of sheet feeding cassettes 23 provided in the sheet feeding table 31.

When forming a copy of an original document with this copying machine, an original document is set in the auto document feeder 28 or manually set on the contact glass 27 by opening the auto document feeder 28. After a start switch (not shown) is pressed, the original document reading device 20 reads an image of the original document set on the contact glass 27 by separating the colors, and converts each of the separated colors (i.e., black and red) into electronic digital image signals.

Substantially simultaneously, a transfer material is fed out from one of the sheet feeding cassettes 23 by rotating one of sheet feeding rollers 33. The transfer material is conveyed by sheet conveying rollers 34 in the sheet conveying path 24 to a pair of registration rollers 35. The registration rollers 35 feed the transfer material at an appropriate timing in synchronization with rotation of the photoreceptor 11 toward the lower part of the photoreceptor 11. Alternatively, a transfer material set on the manual sheet feeding tray 29 is fed by a pair of sheet feeding rollers 36 into the sheet conveying path 24. The transfer material is further fed by the registration rollers 35 at an appropriate timing in synchronization with rotation of the photoreceptor 11 toward the lower part of the photoreceptor 11.

At substantially the same time as the pressing of the start switch (not shown), the photoreceptor 11 is driven to rotate in a clockwise direction in FIG. 1. While rotating the photoreceptor 11, the first charging device 12 uniformly charges the surface of the photoreceptor 11. Then, the surface of the photoreceptor 11 is irradiated with a laser beam (L) emitted from the first image writing device 16 in accordance with the black digital image signal sent from the original document reading device 20. As a result, an electrostatic latent image corresponding to the black component of the color image of the original document is formed on the surface of the photoreceptor 11. Subsequently, the first developing device 13 develops the electrostatic latent image with black toner, thereby forming a black toner image on the surface of the photoreceptor 11.

After passing the position of the first developing device 13, the surface of the photoreceptor 11 is uniformly charged with the second charging device 37. The surface of the photoreceptor 11 is then irradiated with a laser beam emitted from the second image writing device 38 in accordance with the red digital image signal sent from the original document reading device 20. Thereby, an electrostatic latent image corresponding to the red component of the color image of the original document is formed on the photoreceptor 11 such that the electrostatic latent image corresponding to the red component is superimposed on the above-described black toner image. Subsequently, the second developing device 39 develops the electrostatic latent image with red toner, thereby forming a red toner image. As a result, a two-color image composed of black and red toner images is formed on the photoreceptor 11.

Subsequently, the two-color image is transferred to a transfer material fed to the lower part of the photoreceptor 11, by the transfer/conveyance device 14. After the two-color image is transferred from the photoreceptor 11 to the transfer material, the cleaning device 15 removes residual toner remaining on the surface of the photoreceptor 11 in preparation for the next image forming operation.

The transfer material having a transferred two-color image is conveyed to the fixing device 17 by the transfer/conveyance device 14. The two-color image is fixed onto the transfer material by the heat and pressure of the fixing roller 18 and the pressure roller 19 in the fixing device 17. Subsequently, the transfer material carrying a fixed image is conveyed in the sheet discharging path 25 and discharged from the main body 10 to the sorter 30.

When forming images on both sides of a transfer material, a transfer material having a fixed image on the first side of the transfer material is conveyed to the duplex unit 22 through the sheet discharging path 25 and the reverse path 26. The transfer material is reversed in the duplex unit 22 and is conveyed to the sheet conveying path 24 again. Subsequently, a toner image for the second side of the transfer material is transferred from the photoreceptor 11 to the second side of the transfer material by the transfer/conveyance device 14. After the toner image is fixed to the second side of the transfer material in the fixing device 17, the transfer material carrying fixed images on both sides thereof is discharged from the main body 10 to the sorter 30.

Figure 2:
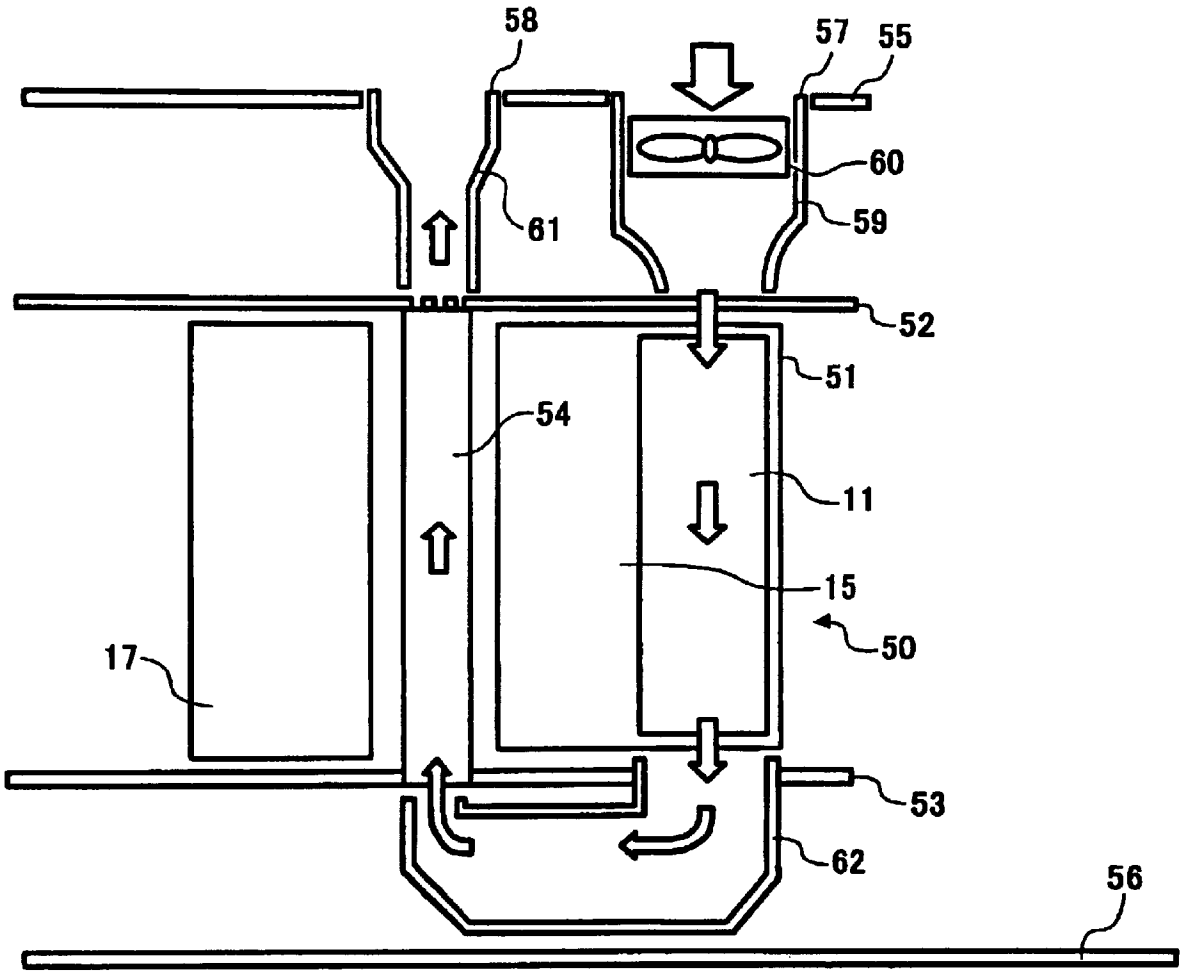
FIG. 2 is a schematic top view of a cooling device in the copying machine of FIG. 1.

In the above-described two-color copying machine, as illustrated in FIG. 2, the drum-shaped photoreceptor 11 and the cleaning device 15 are integrally accommodated in a unit case 51 of a process unit 50. The process unit 50 and the fixing device 17 are supported between a pair of face plate-shaped side plates 52 and 53 in the main body 10 of the copying machine. The pair of side plates 52 and 53 are provided opposite to each other at the rear and front sides of the copying machine, respectively.

Although not shown, flanges are attached onto both ends of the photoreceptor 11, respectively. The photoreceptor 11 is rotatably supported by the unit case 51 of the process unit 50 while a shaft passing through centers of the flanges is supported by the unit case 51 via bearings. A plurality of sector-shaped openings are formed in each of the flanges at the portion around the shaft. Air is led into the photoreceptor 11 through the openings (described in more detail below).

In this embodiment, a duct 54 is provided between the cleaning device 15 (a toner storing device) and the fixing device 17 (a heat source), at a position where the duct 54 does not interfere with the conveyance of transfer materials by the transfer/conveyance device 14. The duct 54 has a U-shaped cross section and opens toward the cleaning device 15. The opening side of the duct 54 is covered by the unit case 51 of the process unit 50 disposed adjacent to the duct 54, and thereby forms an air flow path in the duct 54.

Exterior covers 55 and 56 are provided at the outside of the side plates 52 and 53, respectively. The exterior cover 55 provided at the rear side of the copying machine, includes an air intake vent 57 and an air exhaust vent 58 provided adjacent to each other. In addition, an air intake duct 59 is provided at the air intake vent 57 to lead air taken in from the air intake vent 57 to one end side of the photoreceptor 11 through openings formed in the side plate 52 and the unit case 51. An air intake fan 60 is provided in the air intake duct 59. Furthermore, an air exhaust duct 61 is provided at the air exhaust vent 58 to lead air from one end side of the duct 54 to the air exhaust vent 58 through another opening formed in the side plate 52.

A U-turn duct 62 connecting the other end side of the photoreceptor 11 and the other end side of the duct 54 is provided between the side plate 53 at the front side of the copying machine, and the exterior cover 56. An airflow path is formed in the main body 10 of the copying machine. Specifically, the air intake fan 60 leads air taken in from the air intake vent 57 into the photoreceptor 11 from the one end side of the photoreceptor 11 (i.e., on the rear side of the copying machine) through the air intake duct 59. The air flows through the photoreceptor 11 and is discharged from the other end side of the photoreceptor 11 (i.e., on the front side of the copying machine), and makes a U-turn while flowing through the U-turn duct 62. The air further flows through the duct 54 and returns to a position on the one end side of the photoreceptor 11 in the main body 10 of the copying machine. Subsequently, the air is discharged from the main body 10 through the air exhaust duct 61 and the air exhaust vent 58. With the above-described airflow path and elements, a cooling device is constructed in the main body 10 of the copying machine.

With the above-described airflow, air can efficiently cool the inside of the main body 10 of the copying machine. In the main body 10 of the copying machine, the toner stored in the cleaning device 15 may change its physical properties and fuse under the influence of the heat generated in the fixing device 17. For example, the fused toner may agglomerate and solidify. However, the above-described cooling airflow can prevent the change of physical properties, agglomeration, and solidification of toner stored in the cleaning device 15.

When forming images on both sides of a transfer material, a transfer material which is heated once in the fixing device 17 in order to fix a toner image on one side of the transfer material, contacts the photoreceptor 11 again to receive a toner image from the photoreceptor 11 on the other side of the transfer material. In this case, the photoreceptor 11 may be heated to a temperature above an allowable level by contact with the heated transfer material. However, with the above-described cooling device in the copying machine, the excessive rise of the temperature of the photoreceptor 11 can be prevented by passing air through the photoreceptor 11. Further cooling the photoreceptor 11 can prevent an increase in the temperature of a device, such as the cleaning device 15 adjacent to the photoreceptor 11.

In the above-described construction of the copying machine, the air intake vent 57 and the air exhaust vent 58 are provided on the same plane on the back side of the main body 10 of the copying machine. When the copying machine is placed such that the plane of the back side of the main body 10 of the copying machine is directed toward a wall of a room, the noise emanating from the main body 10 does not directly reach users, and thereby the noise volume to which users are exposed can be reduced.

In the above-described illustrative embodiment, the duct 54 is interposed between the cleaning device 15 and the fixing device 17 such that the opening of the duct 54 is directed toward the cleaning device 15. Further, an airflow path is formed in the duct 54 by covering the opening of the duct 54 by the unit case 51. Thus, air having a low temperature and flowing in the airflow path directly contacts and cools the unit case 51. With this construction, the cleaning device 15 in the main body 10 of the copying machine can be efficiently cooled.

Figure 3:
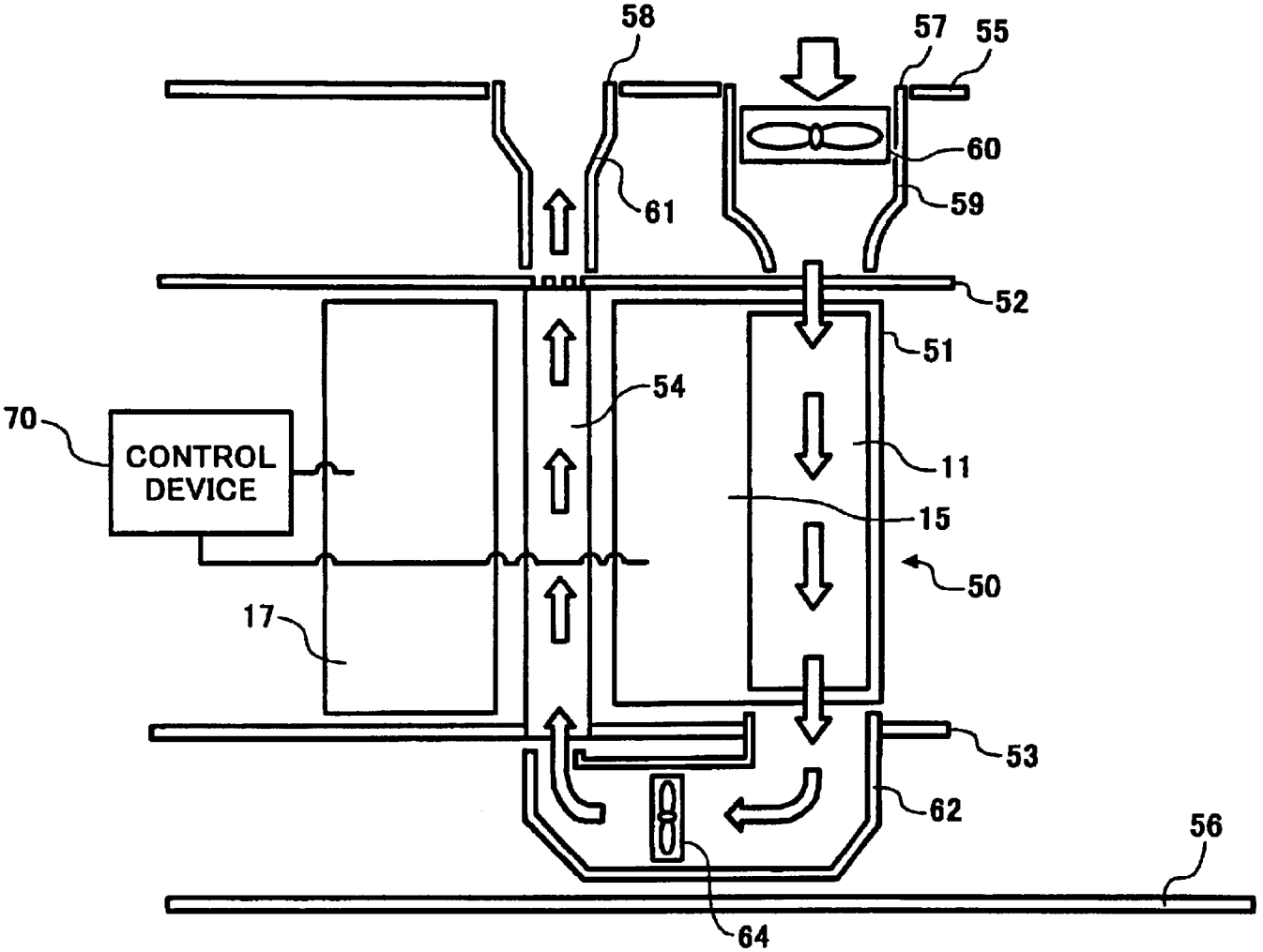
FIG. 3 is a schematic top view of a cooling device in the copying machine of FIG. 1 according to another embodiment of the present invention.

FIG. 3 is a schematic top view of a cooling device in the main body 10 according to another embodiment of the present invention. As an alternative construction of the cooling device in FIG. 2, a fan 64 may be provided in the U-turn duct 62 at a position where the airflow path makes a U-turn, as illustrated in FIG. 3. Because pressure loss tends to occur in the U-turn duct, by providing the fan 64 in the U-turn duct 62, the volume of airflow in the airflow path increases and an amount of airflow sufficient to provide the necessary level of cooling can be provided. Furthermore, in the cooling device of FIG. 3, because the fan 64 is provided at the position away from the air intake vent 57 and the air exhaust vent 58, the noise of the fan 64 emanating from the main body 10 is reduced, and the size of the air intake fan 60 disposed adjacent to the air intake vent 57 may reduced or eliminated. As a result, the noise level coming from the main body 10 can be suppressed.

Figure 4:
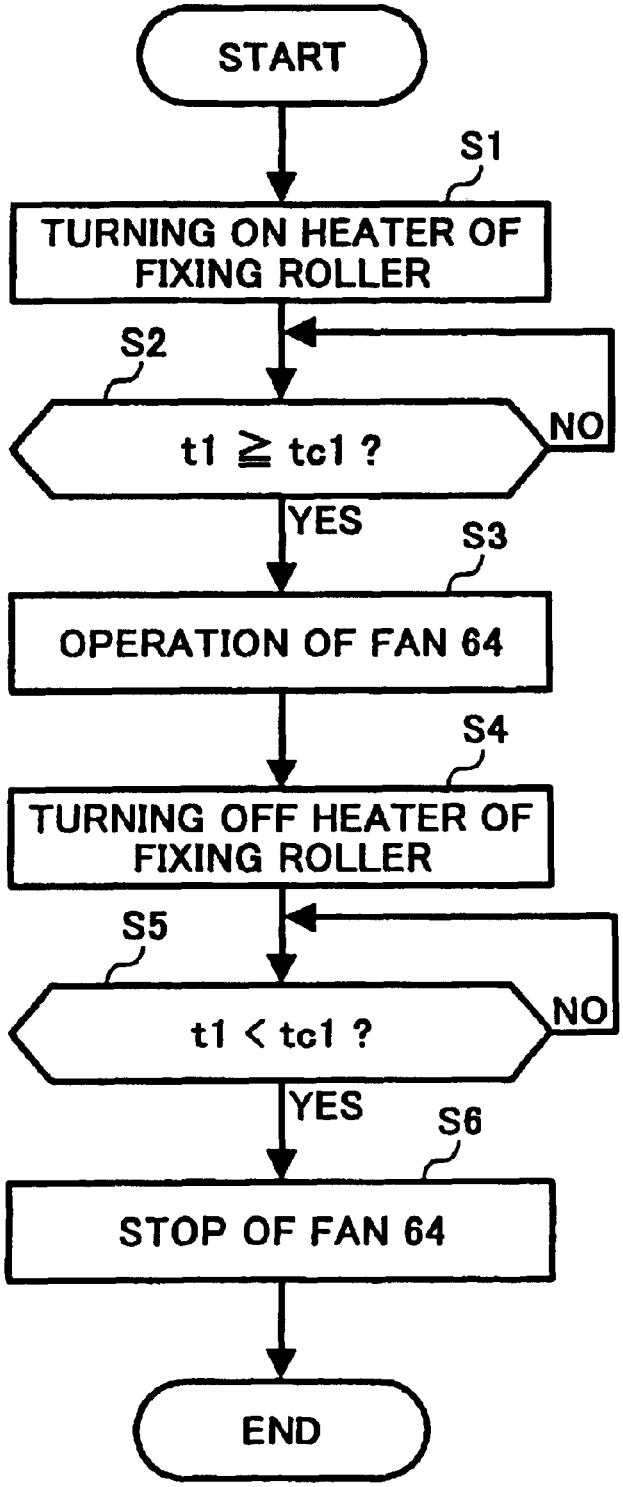
FIG. 4 is a flowchart illustrating the main steps of a fan control operation of the copying machine according to the embodiment of the present invention.

In the copying machine according to the present embodiment, it is preferable that the operation of the fan 64 be controlled by a control device 70, based on a fixing temperature of the fixing device 17. Although not shown, the control device 70 includes, for example, a central processing unit (CPU), a non-volatile random-access memory (RAM), and a read-only memory (ROM), etc. FIG. 4 is a flowchart illustrating main steps of a fan control operation of the copying machine according to one embodiment of the present invention. After a power supply (not shown) of the main body 10 of the copying machine is turned on, the heater of the fixing roller 18 in the fixing device 17 is turned on in step S1. Subsequently, in step S2, the control device 70 determines if a fixing temperature (t1) of the heater of the fixing roller 18 is equal to or greater than a predetermined threshold value (tc1). If the answer is NO in step S2, the fan control operation returns to re-execute step S2. If the answer is YES in step S2, the control device 70 controls the fan 64 to operate in step S3.

When the image forming operation of the copying machine is completed, the heater of the fixing roller 18 is turned off in step S4 in order to save energy. Subsequently, in step S5, the control device 70 determines if the fixing temperature (t1) of the heater of the fixing roller 18 is less than the threshold value (tc1). If the answer is NO in step S5, the fan control operation returns to re-execute step S5. If the answer is YES in step S5, the control device 70 controls the fan 64 to stop in step S6. In addition, in order to prevent an increase in temperature due to residual heat in the main body 10, it is preferable that the fan 64 be stopped by means of a timer after a predetermined elapsed time, since the control device 70 will determine that the fixing temperature (t1) of the heater of the fixing roller 18 is less than the threshold value (tc1) in step S5.

With the above-described fan control operation based on the fixing temperature of the heater of the fixing roller 18, the unnecessary operation of fan 64 can be prevented when the fixing temperature is relatively low, and while the main body 10 of the copying machine is in standby mode. Accordingly, the temperature and noise in the main body 10 of the copying machine can be efficiently reduced while saving electricity.

Figure 5:
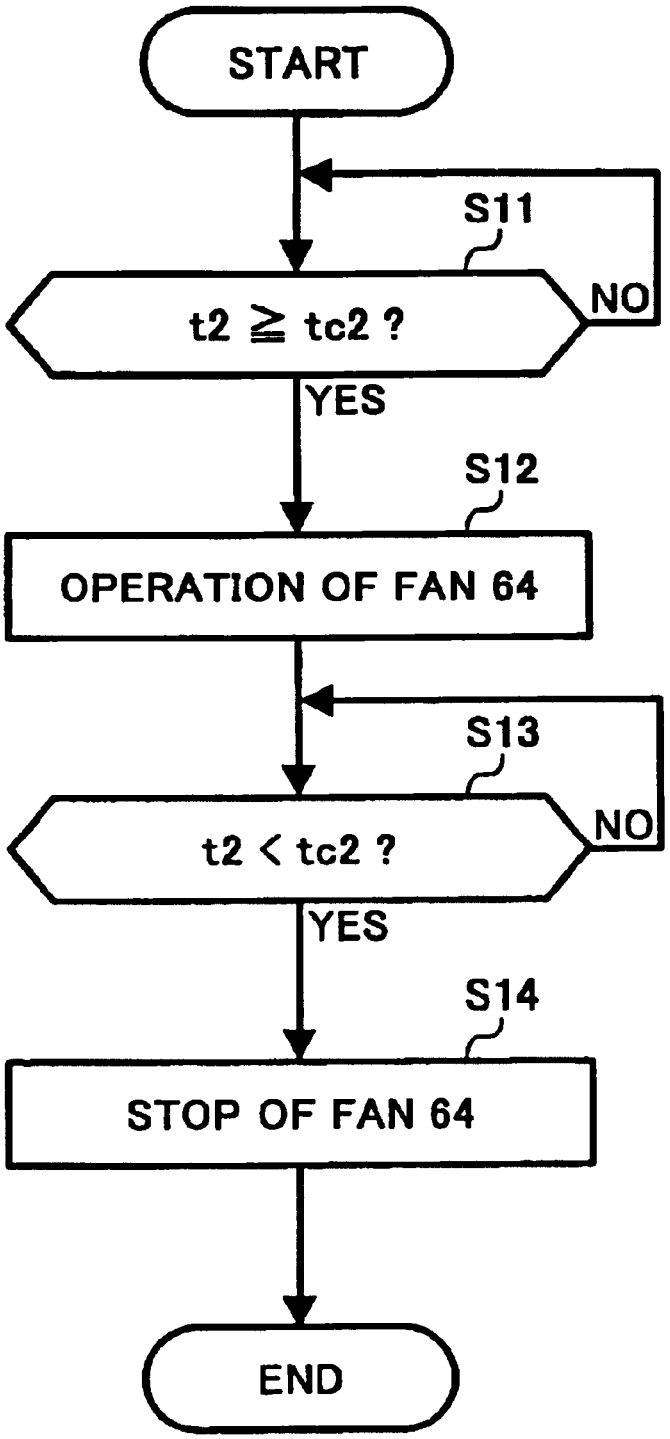
FIG. 5 is a flowchart illustrating the main steps of a fan control operation of the copying machine according to another embodiment of the present invention.

It is preferable that the operation of the fan 64 be controlled by the control device 70, based on a temperature in the cleaning device 15, as detected by a temperature sensing element (not shown) provided in the cleaning device 15. FIG. 5 is a flowchart illustrating the main steps of a fan control operation of the copying machine according to another embodiment of the present invention.

After the power supply (not shown) of the main body 10 of the copying machine is turned on, the control device 70 determines if a temperature (t2) in the cleaning device 15 detected by the temperature sensing element is equal to or greater than a predetermined threshold value (tc2) in step S11. If the answer is NO in step S11, the fan control operation returns to re-execute step S11. If the answer is YES in step S11, the control device 70 controls the fan 64 to operate in step S12.

Subsequently, in step S13, the control device 70 determines if the temperature (t2) in the cleaning device 15 detected by the temperature sensing element is less than the threshold value (tc2). If the answer is NO in step S13, the fan control operation returns to re-execute step S13. If the answer is YES in step S13, the control device 70 controls the fan 64 to stop in step S14.

With the above-described fan control operation based on the temperature in the cleaning device 15, unnecessary operation of the fan 64 can be prevented when the temperature in the cleaning device 15 is relatively low. Therefore, the temperature and noise in the main body 10 of the copying machine can be efficiently reduced while saving electricity.

The present invention has been described with respect to the embodiments as illustrated in Figures. However, the present invention is not limited to these embodiments and may be practiced otherwise.

In the above embodiments, the cleaning device 15 is described as an example of a toner storing device which requires air cooling. The toner storing device is not limited to a cleaning device, and may be a developing device, a toner supply bottle, a waste toner collecting tank, a toner recycle path, or other similar device for storing toner.

In the above embodiments, the cooling device is used in a two-color copying machine in which a toner image formed on the photoreceptor 11 is transferred to a transfer material. Instead of a two-color copying machine, the cooling device may be used in an image forming apparatus in which a toner image formed on an image carrier is transferred to an intermediate transfer element, and then the toner image is transferred from the intermediate transfer element to a transfer material. Moreover, the cooling device may be used in a single color or multi-color (e.g. three colors, four colors, etc.) image forming apparatus.

The present invention has been described with respect to a copying machine as an example of an image forming apparatus. However, the present invention may be applied to other types of image forming apparatus, such as a printer, a facsimile machine, etc. or a multi-functional image forming apparatus.

Numerous additional modifications and variations of the present invention are possible in light of the above teachings. It is therefore to be understood that within the scope of the appended claims, the present invention may be practiced otherwise than as specifically described herein.

The priority document of the present application, Japanese Patent Application No. 2002-026662, filed Feb. 4, 2002, is incorporated by reference herein in its entirety.

What is claimed:

1. An image forming apparatus, comprising:

an image carrier, wherein the image carrier has a first end side and a second end side on opposite ends of the image carrier;

a toner storing device disposed adjacent to the image carrier;

a fixing device; and a cooling device, wherein the cooling device comprises an airflow path in which air enters the image carrier through the first end side of the image carrier, flows through the image carrier, and makes a U-turn on the second end side of the image carrier, and flows through a space between the toner storing device and the fixing device, and returns to a position on the first end side of the image carrier in a main body of the image forming apparatus.

2. The image forming apparatus according to claim 1, wherein the cooling device comprises a duct disposed in the space between the toner storing device and the fixing device, wherein an opening of the duct is directed toward the toner storing device, and wherein a part of the airflow path is formed in the duct by covering the opening of the duct by the outside of the toner storing device.

3. The image forming apparatus according to claim 1, wherein the cooling device further comprises a fan at a position where the airflow path makes a U-turn.

4. The image forming apparatus according to claim 3, further comprising a control device, wherein the control device at least controls the operation of the fan based on a fixing temperature of the fixing device.

5. The image forming apparatus according to claim 3, further comprising a control device, wherein the control device at least controls the operation of the fan based on a temperature in the toner storing device.

6. An image forming apparatus, comprising:

image carrying means for carrying a latent image on the image carrying means, wherein the image carrying means comprises a first end side and a second end side on opposite ends of the image carrying means;

toner storing means for storing toner disposed adjacent to the image carrying means;

fixing means for fixing the toner image on a transfer material by heat, and cooling means for cooling the inside of a main body of the image forming apparatus, wherein the cooling means comprises an airflow path in which air enters the image carrying means through the first end side of the image carrying means, flows through the image carrying means, and makes a U-turn on the second end side of the image carrying means, and flows through a space between the toner storing means and the fixing means, and returns to a position on the first end side of the image carrying means in a main body of the image forming apparatus.

7. The image forming apparatus according to claim 6, wherein the cooling means comprises a duct disposed in the space between the toner storing means and the fixing means, wherein an opening of the duct is directed toward the toner storing means, and wherein a part of the airflow path is formed in the duct by covering the opening of the duct by the outside of the toner storing means.

8. The image forming apparatus according to claim 6, wherein the cooling means further comprises a fan at a position where the airflow path makes a U-turn.

9. The image forming apparatus according to claim 8, further comprising a control means for controlling the fan, wherein the control means controls the operation of the fan based on a fixing temperature of the fixing means.

10. The image forming apparatus according to claim 8, further comprising a control means for controlling the fan, wherein the control means controls the operation of the fan based on a temperature in the toner storing means.

11. A method of cooling an inside of a main body of an image forming apparatus, comprising:

flowing air into an image carrier from a first end side of the image carrier;

causing the air to make a U-turn in a U-turn duct;

flowing the air through a space between a toner storing device and a fixing device; and returning the air to a position on the first end side of the image carrier in a main body of the image forming apparatus.

12. The method according to claim 11, further comprising providing a fan at a position where the air makes a U-turn.

13. The method according to claim 12, further comprising controlling the fan to operate based on a fixing temperature of the fixing device.

14. The method according to claim 12, further comprising controlling the fan to operate based on a temperature in the toner storing device.

15. An image forming apparatus, comprising:

an image carrier comprising a first end side and a second end side;

a toner storing device;

a fixing device; and a cooling device, wherein the cooling device comprises an airflow path in which air enters the image carrier through the first end side of the image carrier, flows through the image carrier, and makes a U-turn on the second end side of the image carrier, and flows through a space between the toner storing device and the fixing device, and returns to a position on the first end side of the image carrier in a main body of the image forming apparatus.

16. An image forming apparatus according to claim 1, wherein the image forming apparatus forms images having two or more colors.

17. The image forming apparatus according to claim 1, wherein the image forming apparatus performs multi-functional image forming operations comprising at least one of copying, faxing, and printing operations.

18. The image forming apparatus according to claim 6, wherein the image forming apparatus performs multi-functional image forming operations comprising at least one of copying, faxing, and printing operations.

* * * * *